US008821182B2

(12) United States Patent
Hayman et al.

(10) Patent No.: US 8,821,182 B2
(45) Date of Patent: Sep. 2, 2014

(54) ELECTRICAL CONNECTOR

(75) Inventors: Jeff Hayman, St Albert (CA); Jeremy MacGillivray, Edmonton (CA); Kevin Bailey, Ottawa (CA); John Kim, Ottawa (JP)

(73) Assignee: J2 Light Inc., St. Albert, Alberta (CA)

( * ) Notice: Subject to any disclaimer, the term of this patent is extended or adjusted under 35 U.S.C. 154(b) by 0 days.

(21) Appl. No.: 13/586,864

(22) Filed: Aug. 16, 2012

(65) Prior Publication Data

US 2013/0095689 A1 Apr. 18, 2013

Related U.S. Application Data

(60) Provisional application No. 61/524,283, filed on Aug. 16, 2011.

(51) Int. Cl.
*H01R 13/627* (2006.01)

(52) U.S. Cl.
USPC ..... 439/359

(58) Field of Classification Search
USPC ..... 439/359, 687, 171, 320, 481–484, 439/311–323; 362/85, 194, 394
See application file for complete search history.

(56) References Cited

U.S. PATENT DOCUMENTS

| | | | | |
|---|---|---|---|---|
| 3,428,340 | A * | 2/1969 | Pelton | 285/95 |
| 5,819,405 | A * | 10/1998 | Marder et al. | 29/857 |
| 6,350,139 | B1 * | 2/2002 | Haag | 439/320 |
| 6,354,521 | B1 * | 3/2002 | Kusilek et al. | 239/600 |
| 6,358,076 | B1 * | 3/2002 | Haag | 439/320 |
| 7,330,115 | B1 * | 2/2008 | Zuba | 340/565 |
| 7,804,252 | B2 * | 9/2010 | Chen | 315/152 |
| 2004/0095080 | A1 * | 5/2004 | Grinneiser | 315/291 |

* cited by examiner

*Primary Examiner* — Jean F Duverne
(74) *Attorney, Agent, or Firm* — Loza & Loza, LLP; Razmig Messerian

(57) ABSTRACT

An electrical connector for an electrical connection is disclosed, comprising a female receptacle to connect to either a male shorting cap or a male plug. The male plug and female receptacle can be fastened to a standard knockout in a light fixture. The male plug and female receptacle have alignment means such that they can only fit together one way, and once together are positively connected by means of a twist-lock ring. The male plug is connected to the female receptacle by aligning the two fins to the two corresponding grooves, and pushing inward such that the protrusions of the female receptacle pass through the indentations in the ring of the male plug. The twist-lock ring is turned and the nubs on the protrusions engage the notches of the female receptacle, creating a removable twist-lock ring.

13 Claims, 19 Drawing Sheets

ELECTRICAL CONNECTOR

CLAIM OF PRIORITY

The present application for patent claims priority to U.S. Provisional Patent Application No. 61/524,283 entitled "Electrical Connector" filed Aug. 16, 2011, the entire disclosure of which is hereby expressly incorporated by reference herein.

BACKGROUND

1. Field

This disclosure relates to electrical connectors and, in particular, an electrical connector for light fixtures.

2. Background

The method by which light fixtures are electrically connected has undergone few changes over the years. Fixtures are fed with power in the form of armoured or flexible cables that are permanently affixed to ceiling junction boxes and to light fixtures with metallic or plastic connectors. These connections are made through an industry standard common knockout opening size of ⅞" diameter in both ceiling junction boxes and fixtures. Depending on the fixture style, there will either be a few knockouts available at a designated splice area as in the example of downlights, or throughout the fixture body to afford convenient access as in the form of fluorescent fixtures that present a larger surface area. The cables will contain enough wires to provide one or more circuits depending on the application. Multi-lamp and dimming fluorescent fixtures will sometimes require more than one circuit to offer different levels of light output or to take advantage of energy savings by reducing the amount of light to suit application need.

Applying permanent wiring in the field is labour intensive and subject to a higher degree of failures and safety related issues as every termination represents a point of risk. Field conditions are much worse than that of a controlled manufacturing process line. Therefore, limiting the amount of terminations and exposure to risk should result in a higher degree of accuracy and safety. The same notion applies to future maintenance should the fixtures experience sub-component failure. Pluggable fixture connections enhance labour savings and increase safety. Making connections hot-pluggable result in further savings as electricians can energize circuits ahead of fixture mounting and determine fixture performance as they go. Once safely installed, a hot pluggable system does not require specialized labour to service, thereby reducing the costs of installation and maintenance. If fixtures fail to perform properly, one simply unplugs and replaces the faulty fixture with an operable fixture. Failures can be more easily addressed in a controlled environment on a test bench. This is much easier, safer, and more cost effective than shutting down complete circuits and trying to troubleshoot in the field. As electricians understand, troubleshooting can usually occur while one is on a lift in a dark environment. There is therefore a need in the art for a multi-circuit connector which can be mounted in a common knockout that can be safely hot-pluggable while power remains on.

Modular wiring options exist for manufacturers to provide factory wired receptacles on fixtures and cables that can be supplied separately with molded plug ends. Also available are cables with molded plugs which can be wired to the fixtures at the factory and connected to discrete receptacles that get mounted to ceiling junction boxes. An example of this is Canadian Patent No. 1,219,307, and modular wiring systems produced by Electec™. Drawbacks observed in the present state of the art are that custom openings are needed on fixtures or junction boxes to house molded receptacles, or receptacles mounted through standard knockout openings present extra dimension to the fixtures such that custom packaging becomes a requirement. The added profile also presents the opportunity for greater damage during transit and handling. Molded receptacles and plug cabling are offered in discrete circuit, voltage, and length formats that are inflexible to changing field requirements. If different circuiting, voltage, or different cable lengths are required at time of installation, the installer may have to wait for full manufacturing lead time or endure expensive field rewiring.

Connecting fluorescent fixtures to take advantage of multi-lamp electronic ballasts can also be a challenge. Consider that common fluorescent single lamp strip lights are inventoried with one ballast per fixture even though multi-lamp ballasts are available to drive four or more lamps. Reducing ballasts represents cost savings and in our example, saving three ballasts would be remarkable. There are significant barriers to take advantage of this. Safety organizations do not approve of the supply of incomplete products. Therefore, a contractor receiving empty strips and strips with multi-lamp ballasts would have to obtain field certification making the installation process more expensive to administer. Further, the savings in ballast reduction would be offset by the added labour cost in extra fixture wiring and complexity. An option exists to custom order from manufacturers, but again, savings are eroded by the extra administration and forethought required to engineer the needed products ahead of time along with extra lead time needed to manufacture. Flexibility is reduced as changes often experienced in the field may require another full lead time for custom supply. Last, fluorescent strip lights are sometimes mounted individually and sometimes row mounted end to end which requires mechanical connection of the end plates for feed through wiring of power wires and secondary wiring coming from the ballasts. Custom orders become more complex and inflexible as full system wiring must be provided by the manufacturer, whether individual or row mounted, to achieve safety approval.

There is a growing desire to connect energy saving control devices through which power is routed such as occupancy sensors, photo sensors, addressable relays, etc. An example of this is a class of fluorescent fixtures called highbays which are used to light large spaces with high ceilings such as warehouses and recreation facilities. Significant energy savings can often be realized with the use of an occupancy sensor that is mechanically connected to the knockout on the fixture end plates. The sensor turns lamps on when motion is detected within range of view and off after a period of time when motion is not detected. Sensors can be cumbersome to install in the field as the fixture has to be disassembled in order to bring wiring in for splicing and to mechanically connect the sensor through the knockout opening. This can also be done at the fixture manufacturing level, but more lead time is needed and it presents issues for shipping as sensors add significant dimension to the fixture profile making packing difficult and exposure to damage becomes greater. Present state of the art is to provide an occupancy sensor mounted to a junction box that in turn must be fastened to the fixture with the use of tools. A power cord is then plugged into a molded receptacle located on the junction box and in turn, a control wiring cord is then plugged into a molded receptacle located on the fixture. As with other modular wiring discussed above, the receptacle must be custom fit into the fixture. Multiple circuiting is not offered and would require a discretely different molded set of receptacles and plugs.

Considering the prior discussions of electrical quick connect systems, there are no systems that are made for standard dry area applications that can be easily converted to perform in wet applications.

Various devices have been utilized or proposed in order to remedy the aforementioned problems. U.S. Pat. No. 7,874,860 (Starke), U.S. Pat. No. 7,258,564 (Su) and U.S. Pat. No. 6,358,076 (Haag), for instance, are examples of twist-lock mechanisms that serve to secure electrical connections. Haag's device is an electrical connector which can be secured by an independently turning sleeve. On the other hand, Su's device is a more simplistic connector whereby the metal connector itself is twisted thus locking it in place. Meanwhile, Starke's device comprises two connectors, which can be connected to one another and secured by a threaded sleeve. While these devices provide easy to connect mechanisms to create and facilitate a continuous electrical connection, the fact of the bare metallic connectors extending from the plug causes a risk of shock for an installer if improperly handled. Further, such devices are not designed to fit within smaller, standardized ⅞" knockouts common in the lighting industry. As such, a twist-lock device would need to be utilized which could overcome, or at least minimize this risk and be sufficiently small to fit within a standard knockout.

Other devices have been proposed in order to facilitate installation of sensors onto light fixtures. U.S. Pat. No. 7,637,766 (Kauffman et al) and U.S. Pat. No. 5,593,318 (Bilson et al) are examples of such inventions. Bilson's device relates to an electrical receptacle that attaches itself to a luminaire housing, and provides a plurality of electrical contact channels. A photo controller can be fastened to the receptacle by means of a clamp member which is joined to the housing by means of a threaded fastener. Kauffman's receptacle includes similar functions but is fastened to the housing by means of a spring clamp. Unfortunately, these inventions do not allow specific use within a common ⅞" knockout universal to many fluorescent fixtures, and are not designed to make live multiple circuits up to 600V.

As such, there is a need for an electrical connector, with a positive lock capability, that can overcome the drawbacks elaborated herein, while still making it easy, affordable and convenient to install and quickly connect new luminaire housings, or to add control devices (such as a motion sensor) immediately or at a later date of the installation. These features of the invention will be apparent from review of the disclosure, drawings and description of the invention below.

SUMMARY

The present invention provides an electrical connector for an electrical connection comprising a female receptacle to connect to either a male shorting cap or a male plug. The male plug and female receptacle can be fastened to a standard knockout in light fixtures. The male plug and female receptacle have alignment means such that they can only fit together one way, and once together are positively connected by means of a twist-lock ring. The male plug is connected to the female receptacle by aligning two fins to two corresponding grooves, and pushing inward such that protrusions of the female receptacle pass through indentations in a ring of the male plug. The twist-lock ring is turned and nubs on the protrusions engage notches of the female receptacle, creating a removable twist-lock ring.

In a first aspect, the present invention provides an electrical connector for forming an electrical connection on a light fixture having a number of knockouts, comprising a female receptacle adaptable to be connected to one or more knockouts in the light fixture, a male plug adaptable to be connected to the female receptacle, and a twist-lock ring connected to the male plug wherein the male plug and female receptacle are connected through the twist-lock ring.

In a second aspect, the present invention provides a system of light fixtures comprising at least two or more light fixtures connected in tandem wherein each light fixture has a male plug and a female receptacle.

BRIEF DESCRIPTION OF THE DRAWINGS

The invention both as to its organization and method of operation, together with further aspects and advantages thereof, may be best understood by reference to the accompanying drawings and text thereof in light of the brief description therefore.

FIG. **6*a*** is a front perspective view of the male plug.

FIG. **6*b*** is a rear perspective view of the male plug.

Figure 7:
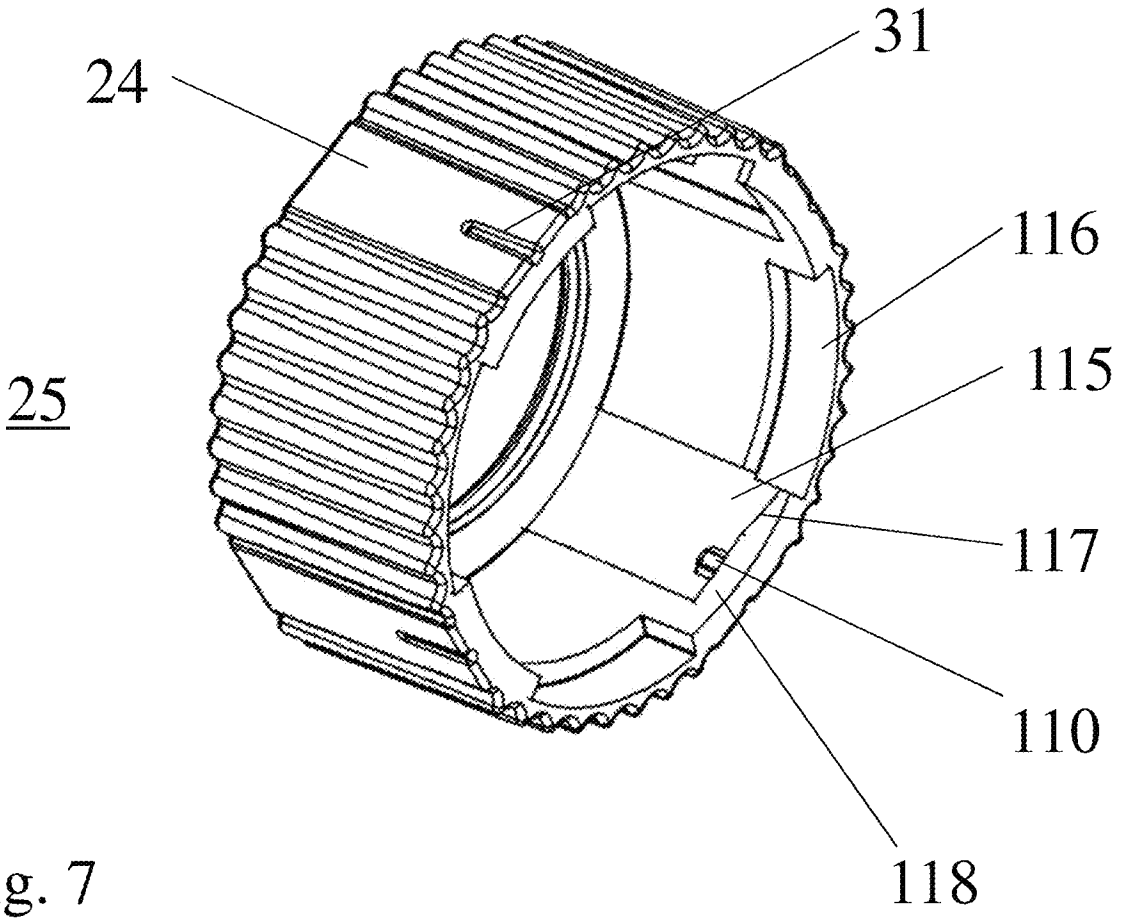

FIG. 7 is a perspective view of a twist-lock ring in isolation.

Figure 8:
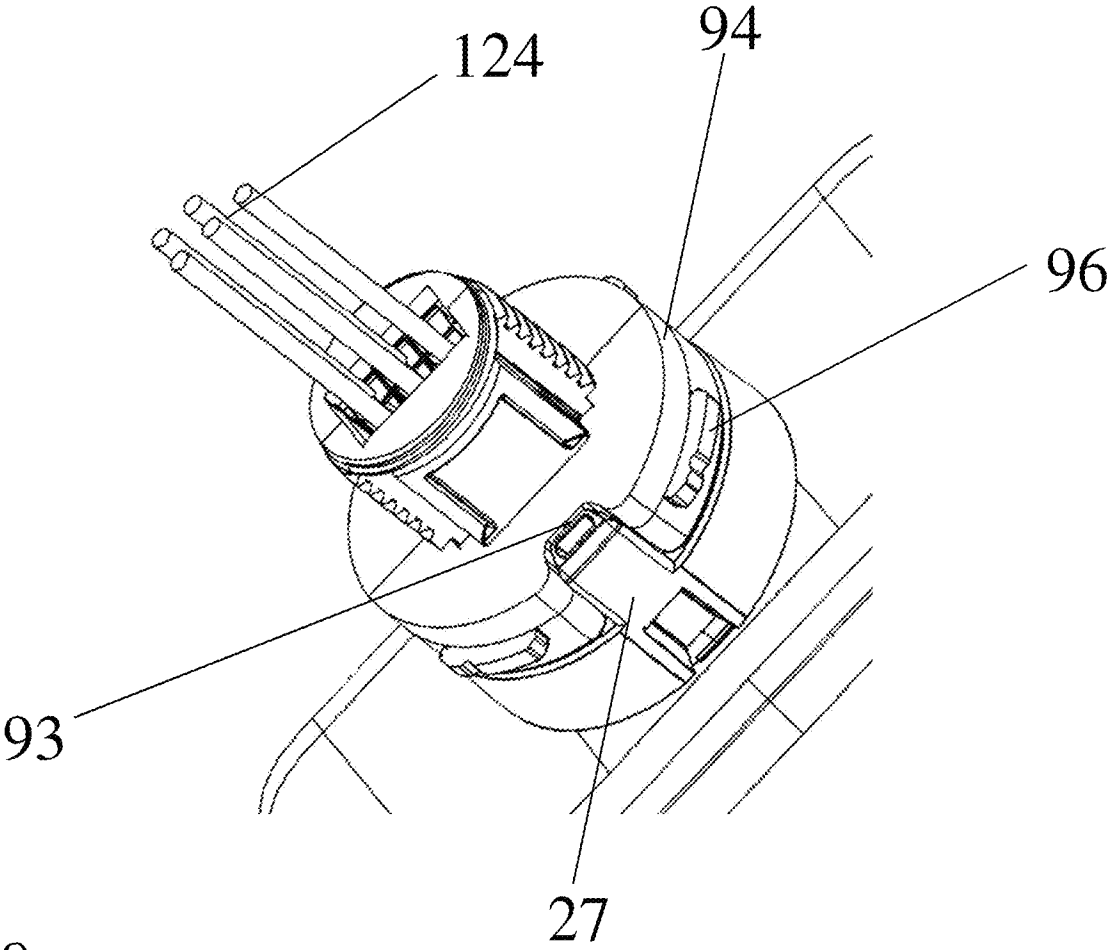

FIG. 8 is a perspective view of the female receptacle connected to the male plug having the twist-lock ring removed for illustrative purposes.

Figure 9:
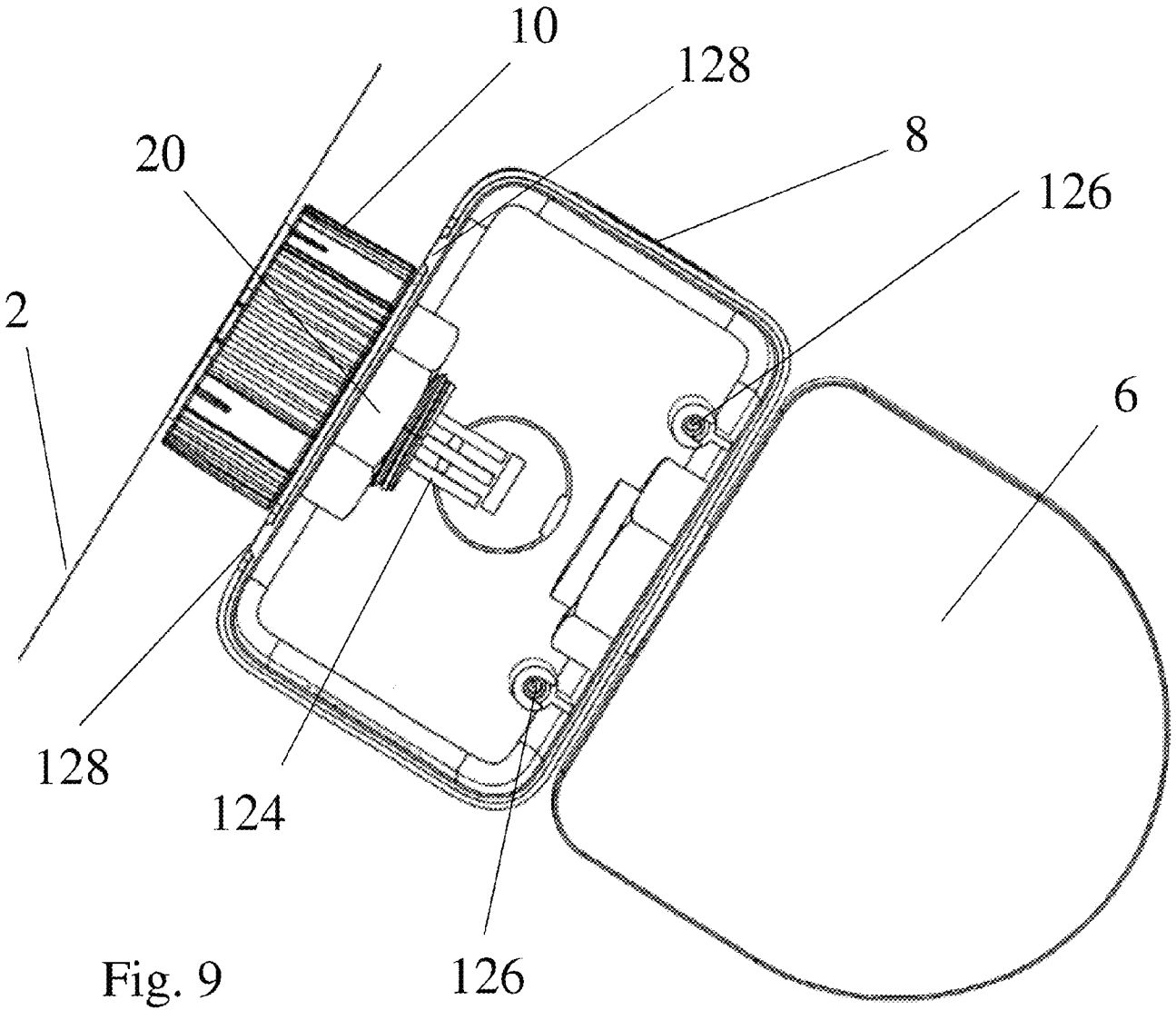

FIG. 9 is a top plan cut away view of a splice box with peripheral.

Figure 10:
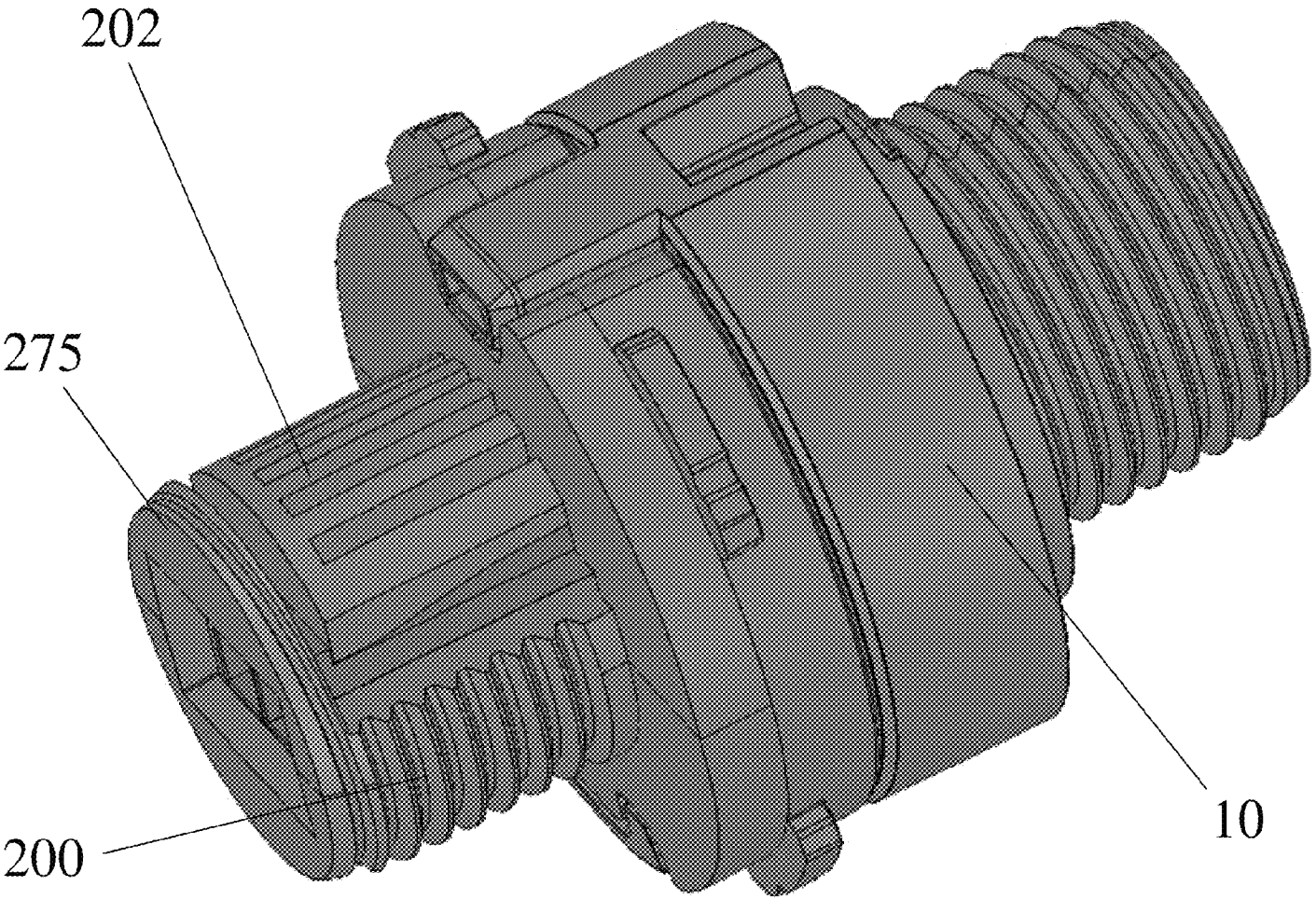

FIG. 10 is a perspective view of a female connecter according to another embodiment of the present invention.

Figure 11:
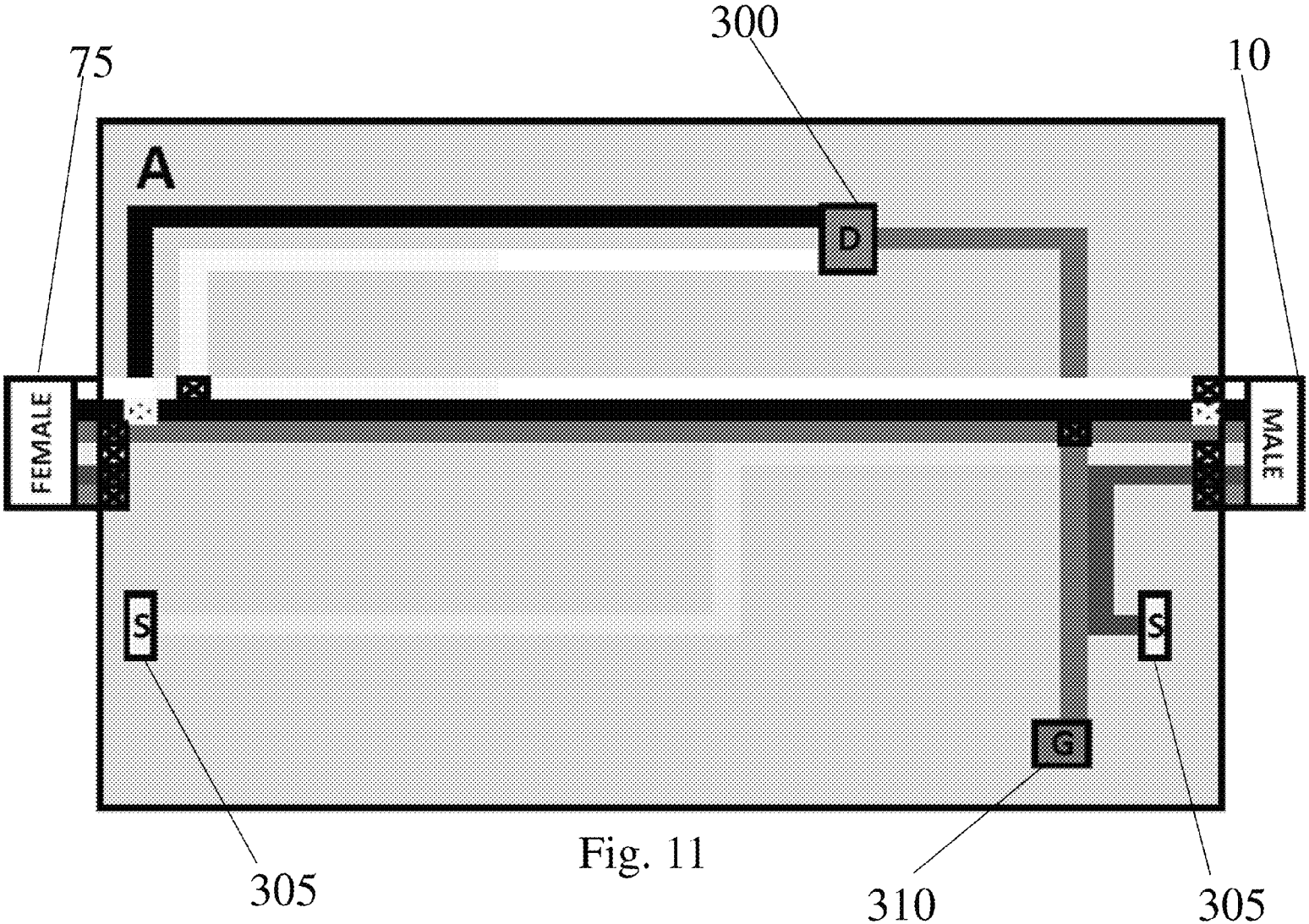

FIG. 11 is a wiring arrangement of a light fixture having a male plug and female receptacle connected to a light fixture according to one embodiment of the present invention.

Figure 12:
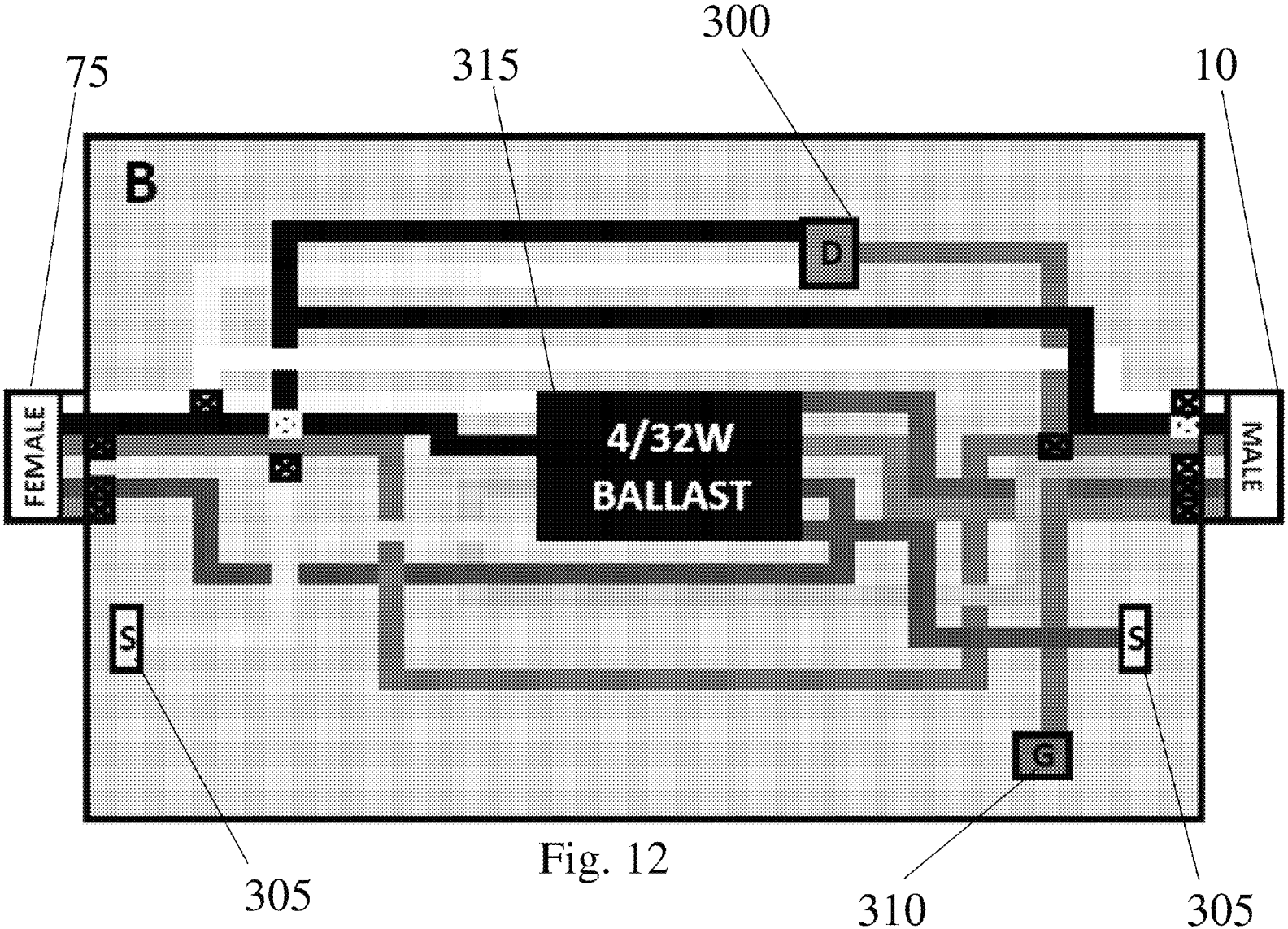

FIG. 12 is a wiring arrangement of a light fixture with a ballast having a male plug and female receptacle connected to a light fixture according to one embodiment of the present invention.

Figure 13:
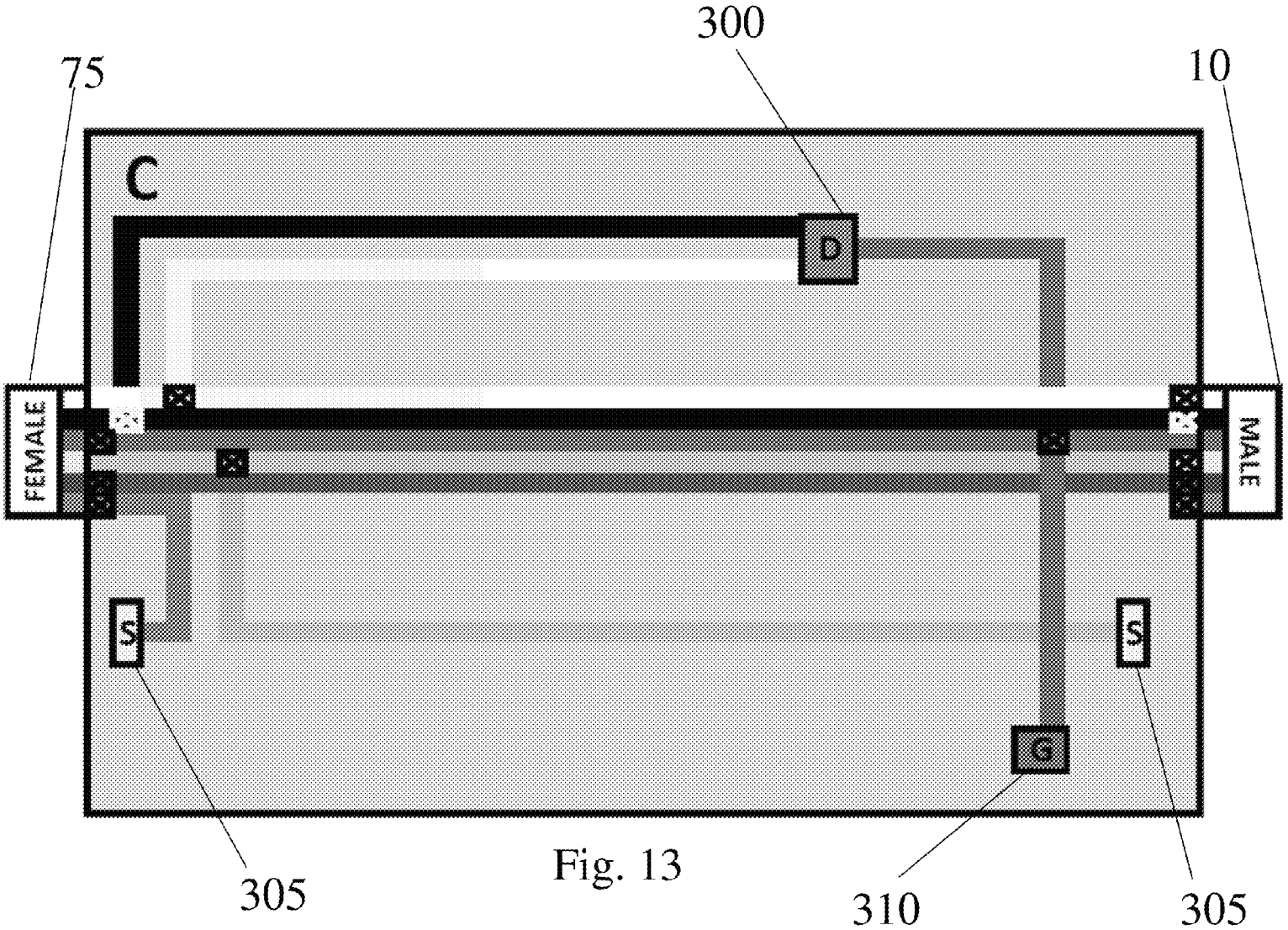

FIG. 13 is another wiring arrangement of a light fixture having a male plug and female receptacle connected to a light fixture according to one embodiment of the present invention.

Figure 14:
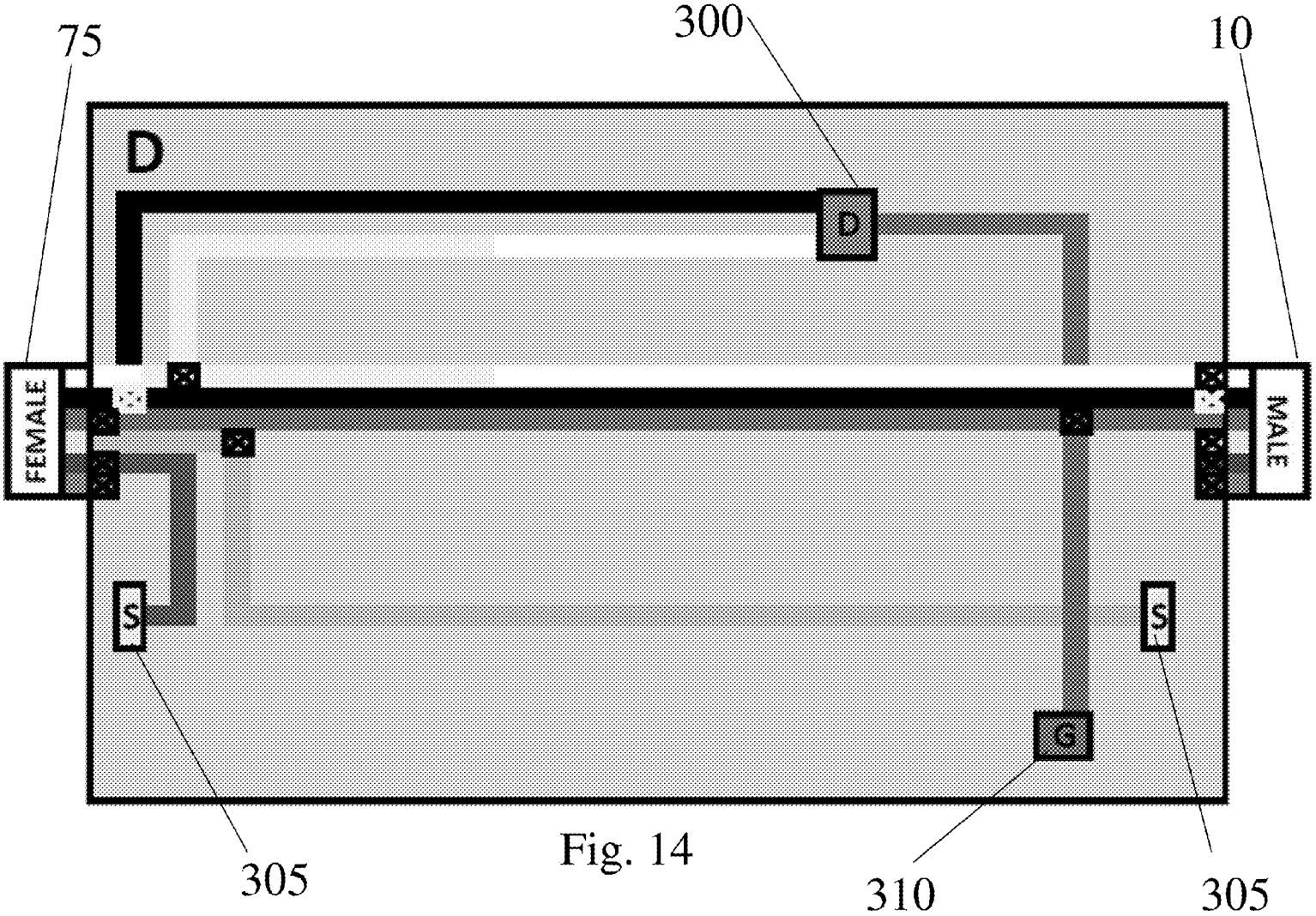

FIG. 14 is another wiring arrangement of a light fixture having a male plug and female receptacle connected to a light fixture according to one embodiment of the present invention.

Figure 15:
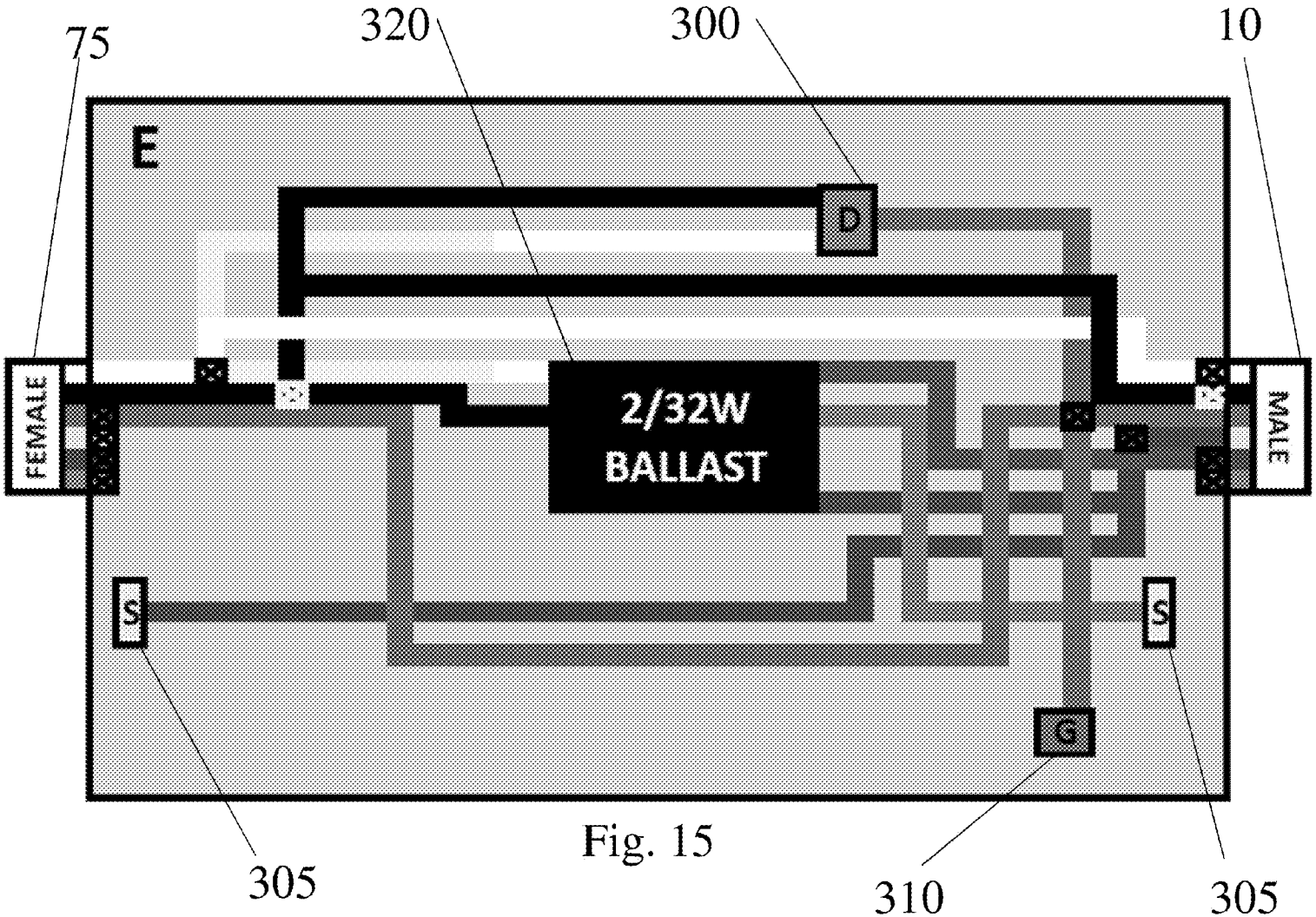

FIG. 15 is another wiring arrangement of a light fixture with a ballast having a male plug and female receptacle connected to a light fixture according to one embodiment of the present invention.

Figure 16:
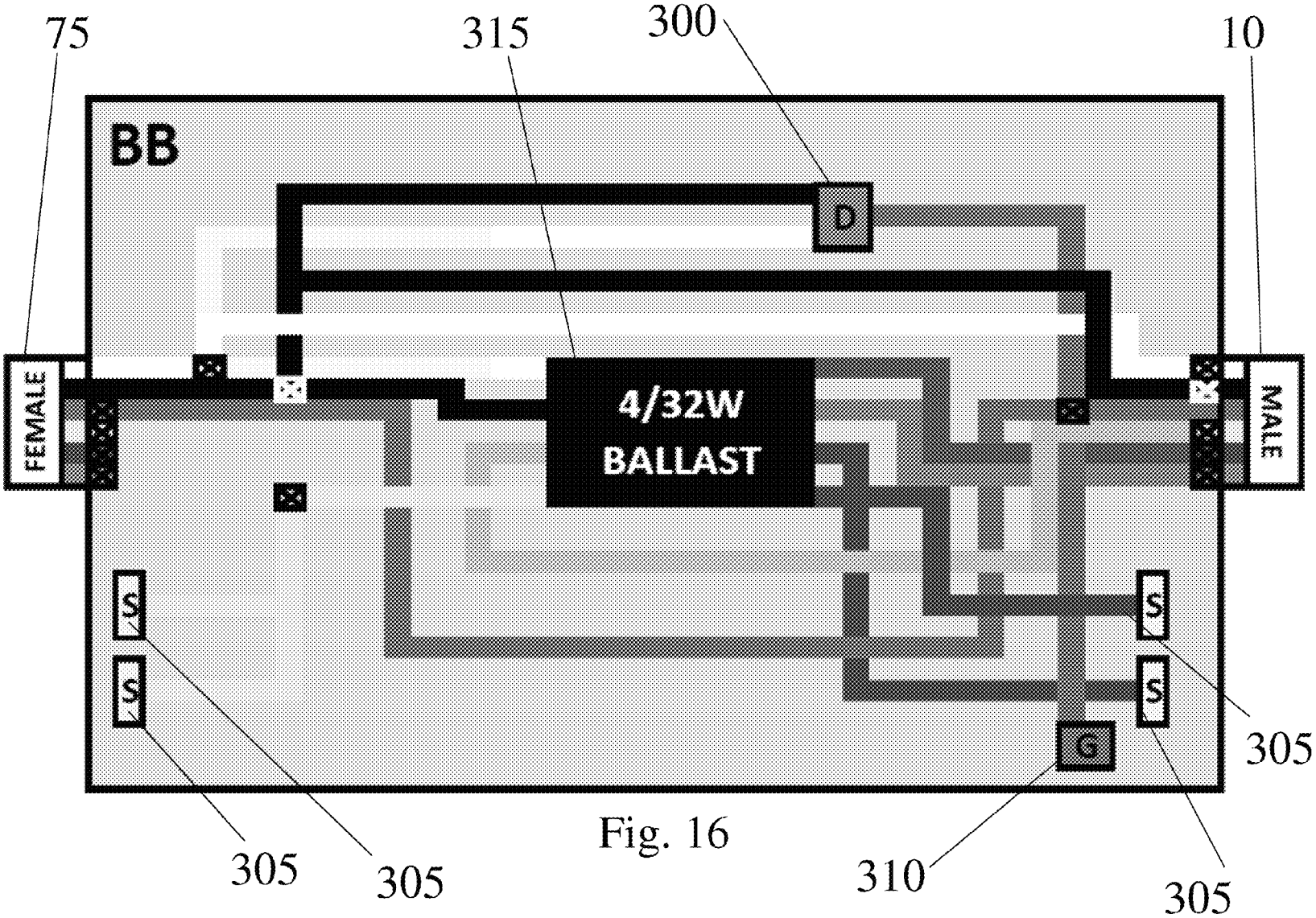

FIG. 16 is another wiring arrangement of a light fixture with a double ballast having a male plug and female receptacle connected to a light fixture according to one embodiment of the present invention.

Figure 17:
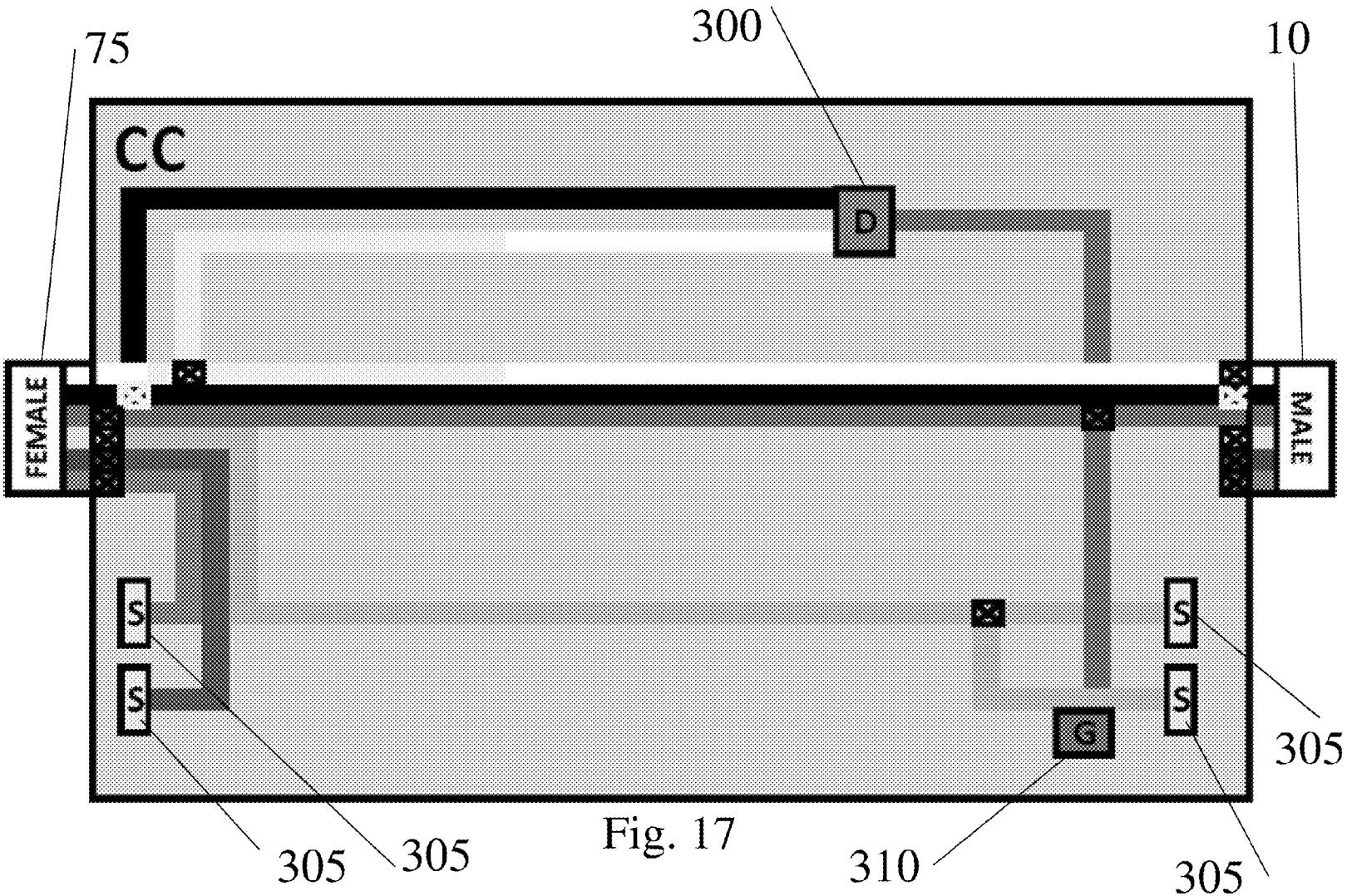

FIG. 17 is another wiring arrangement of a light fixture to be used with another light fixture having a double ballast having a male plug and female receptacle connected to a light fixture.

Figure 18:
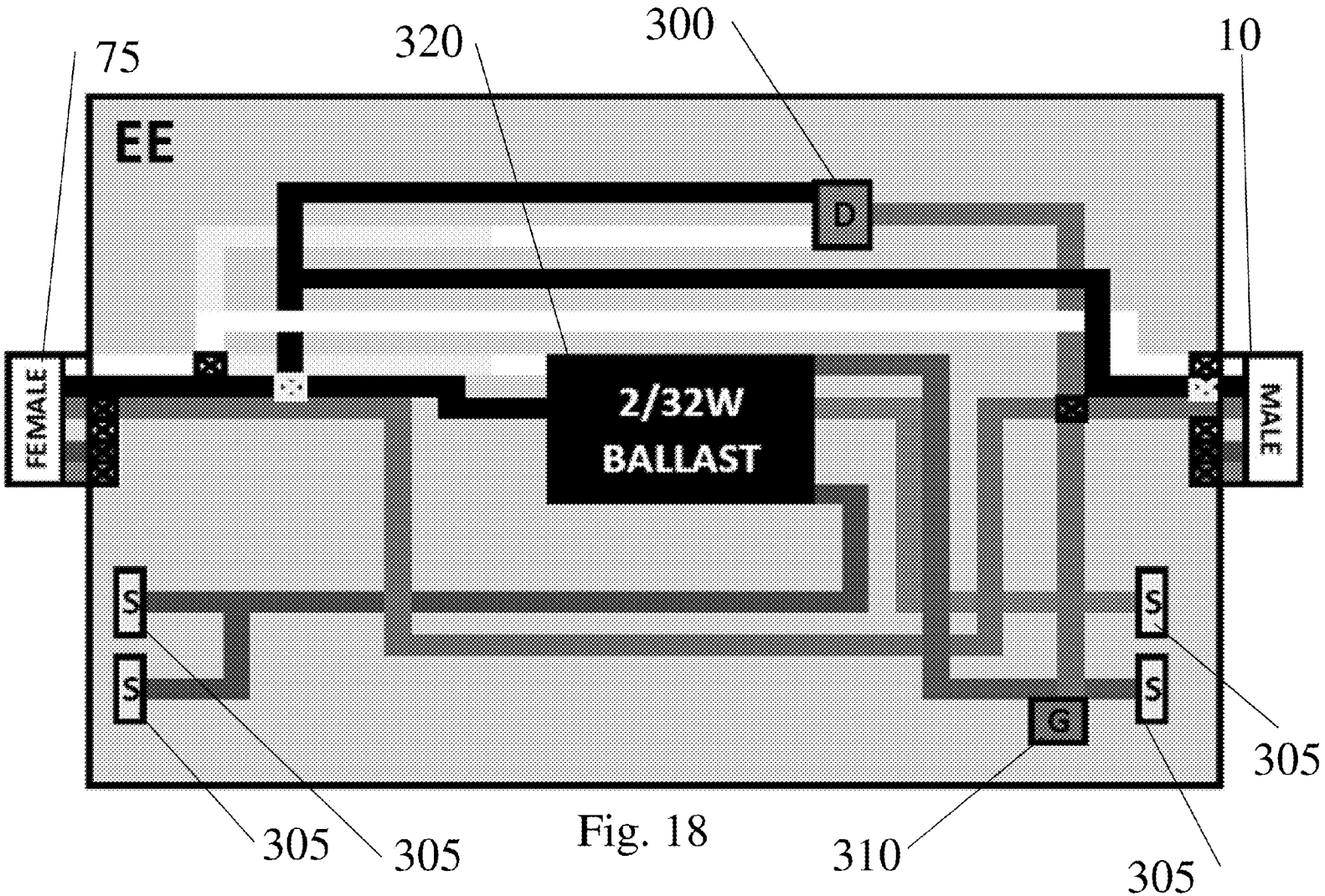

FIG. 18 is another wiring arrangement of a light fixture with a double ballast having a male plug and female receptacle connected to a light fixture.

DETAILED DESCRIPTION

The present invention will now be described more fully hereinafter with reference to the accompanying drawings, in which preferred embodiments of the present invention are shown. This invention may however, be embodied in many different forms and should not be construed as limited to the embodiments set forth herein. Rather, these embodiments are provided so that this application will be thorough in illustrations and brief explanation therefore to convey the true scope of the invention to those skilled in the art. Some illustrations provided herein include detailed explanations of dimension and operation and as such should be not be limited thereto.

The terms "coupled" and "connected", along with their derivatives, may be used herein. It should be understood that these terms are not intended as synonyms for each other. Rather, in particular embodiments, "connected" may be used to indicate that two or more elements are in direct physical or electrical contact with each other. "Coupled" may be used to indicated that two or more elements are in either direct or indirect (with other intervening elements between them) physical or electrical contact with each other, or that the two or more elements co-operate or interact with each other (e.g. as in a cause and effect relationship).

The present device is made up of a collection of parts that interconnect with each other in order to provide an installer or owner of a fluorescent light fixture with a quick, easy and safe mounting connection to a power cord or to an external peripheral such as a motion sensor.

Figure 1:
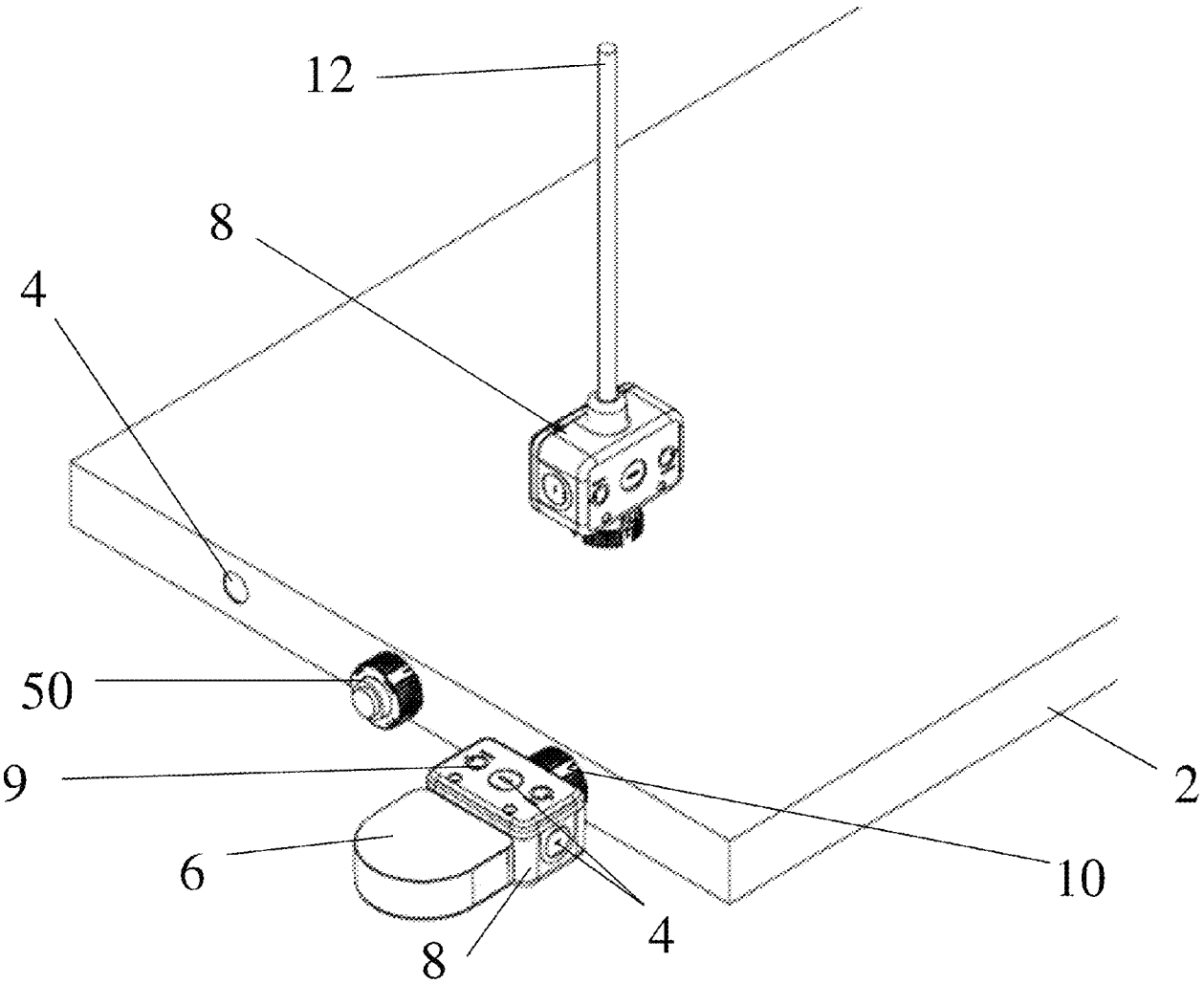
FIG. 1 is a perspective view of a fluorescent light fixture and its various attachments.

With reference to FIG. 1, a fluorescent light fixture 2 is shown, having standardized knockouts 4 therein, and in three of the four knock-outs 4 is mounted an electrical connector. The electrical connector is made up of a female receptacle 75 (not shown, See FIG. 4) and one of two male connecting pieces, a male plug 10 and a male shorting cap 50. In the first instance the connection is to the power supply 12, by means of splice box 8. In the second instance, the connection is to a peripheral 6 such as a motion sensor. In the third instance, there is no peripheral, such that the connector is unused for the moment and closed with a shorting cap 50, which completes the circuit. In one embodiment, the fluorescent light fixture 2 is perforated on its side by knockout 4, which knockout 4 can be fit with the female receptacle 75 (not shown, See FIG. 4). Knockouts 4 are of an industry standard size, typically ⅞", however 1" and 1¼" knockouts are also used. The electrical connector of the present invention is adapted to fit within these standard knockouts. If the female receptacle 75 (not shown, See FIG. 4) is not being used, it may be shorted by means of a shorting cap 50. The shorting cap 50 serves only to bridge the control circuit of the fluorescent light fixture such that it may operate normally without peripheral control device. Alternatively, the female receptacle 75 (not shown, See FIG. 4) may be fitted with a male plug 10, which may be attached to a peripheral 6 or the power supply 12. In that instance, the male plug 10 could be connected to a splice box 8, which would serve as a medium between the male plug 10 and a peripheral 6 or the power supply 12. The splice box 8 has a lid 9 and both have a number of knockouts 4 which may be selectively removed for various orientations of wire or peripheral device connection. The top panel of the fluorescent light fixture 2 would comprise of a knockout 4 fitted with a female receptacle 75 (not shown, See FIG. 4), connected to a male plug 10, which would in turn be connected to a splice box 8. The connection of a splice box 8 to wire a power supply to a fixture is well known in the art.

Figure 2:
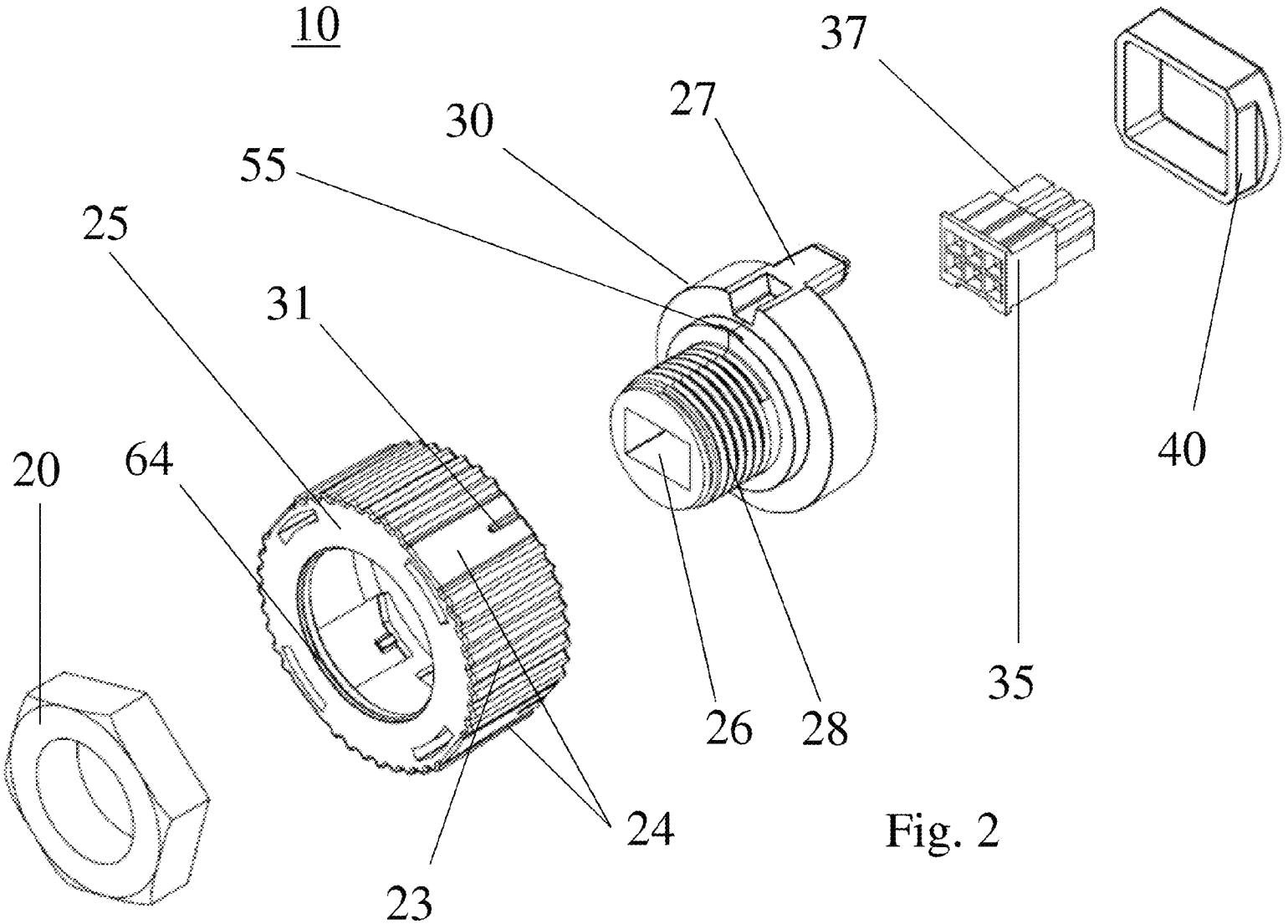
FIG. 2 is an exploded view of a male plug.

With reference to FIG. 2, an exploded view of the male plug 10 is shown. The male plug 10 provides a quick, easy and safe connection to the female receptacle 75 (not shown, See FIG. 4) of the fluorescent light fixture 2 by inserting the male plug 10 and turning a twist-lock ring 25, locking them together. The male plug 10 is shown separated into its main components: a male plug nut 20, the twist-lock ring 25, a splice receptacle 30, a wire housing 35 and an optional male gasket 40. The twist-lock ring 25 has a knurled outer edge 23 for ease of turning, and having alignment surfaces 24 (two shown) for showing the operator where gaps 116 (not shown) are located, which procedure is discussed in greater detail below. The alignment surfaces 24 further comprise male alignment markers 31 that are utilized to align with female alignment markers 97 (not shown, See FIG. 5), discussed in greater detail below.

With further reference to FIG. 2, when assembled, the splice receptacle 30 fits within the twist-lock ring 25 and is fastened to the twist-lock ring 25 by the male plug nut 20. The twist-lock ring 25 sits between the male plug nut 20 and splice receptacle 30 on a lip 55. The splice receptacle 30 is inserted within twist-lock ring 25 until lip 55 makes contact and passes into the inner diameter 64 of the twist-lock ring 25. The male plug nut 20 then rotates around the threads of the splice receptacle 30 until the receptacle 30 is secured within the twist-lock ring 25, but has enough give due to the cessation of the threading 28 short of the lip 55, such that the twist-lock ring 25 can rotate freely, with minimal friction and independently of the other parts of the male plug 10. The splice receptacle 30 has an opening 26 adapted to receive the wire housing 35. The splice receptacle 30 also has an upper fin 27 and a lower fin 29 (not shown, positioned oppositely to the upper fin), which are adapted to be guided into the upper and lower grooves 93, 95 (not shown, See FIG. 4) of the female receptacle 75. The wire housing 35 further comprises fingers 37 that contain the copper wiring 124 (not shown, See FIG. 8), which can be inserted into a female wire receptacle 85 (not shown, See FIG. 4), which contains copper wiring as well. The wire housing 35 can be made of Nylon of suitable grade or other materials known in the art, and shields the copper wiring inserted therein from touch which greatly reduces the chance of shock to the installer.

With further reference to FIG. 2, in one embodiment, one such wire housing 35 is a Molex™ contact, and one skilled in the art would appreciate that the wire housing 35 may comprise any number of contacts, depending on the number of circuits desired, even though the preferable number for the purposes of the present invention is six (6). The wire housing 35 may hold as many electrical connections as possible to fit within the electrical connector adapted to the knockout 4. The connections may be electrical or may be communication signal connections to provide data to a central controller system. Further, due to the spacing between wires within the wire housing 35, the electrical connections therein can carry voltages of 600V or greater, enabling a high-voltage hot-pluggable connection. In a further water-resistant embodiment, the male gasket 40 would be secured within the splice receptacle 30, and make contact with an optional female gasket 80 (not shown, See FIG. 4) to seal the connection from water between the male plug 10 and the female receptacle 75 (shown in FIGS. 5 and 6) for wet applications.

Figure 3:
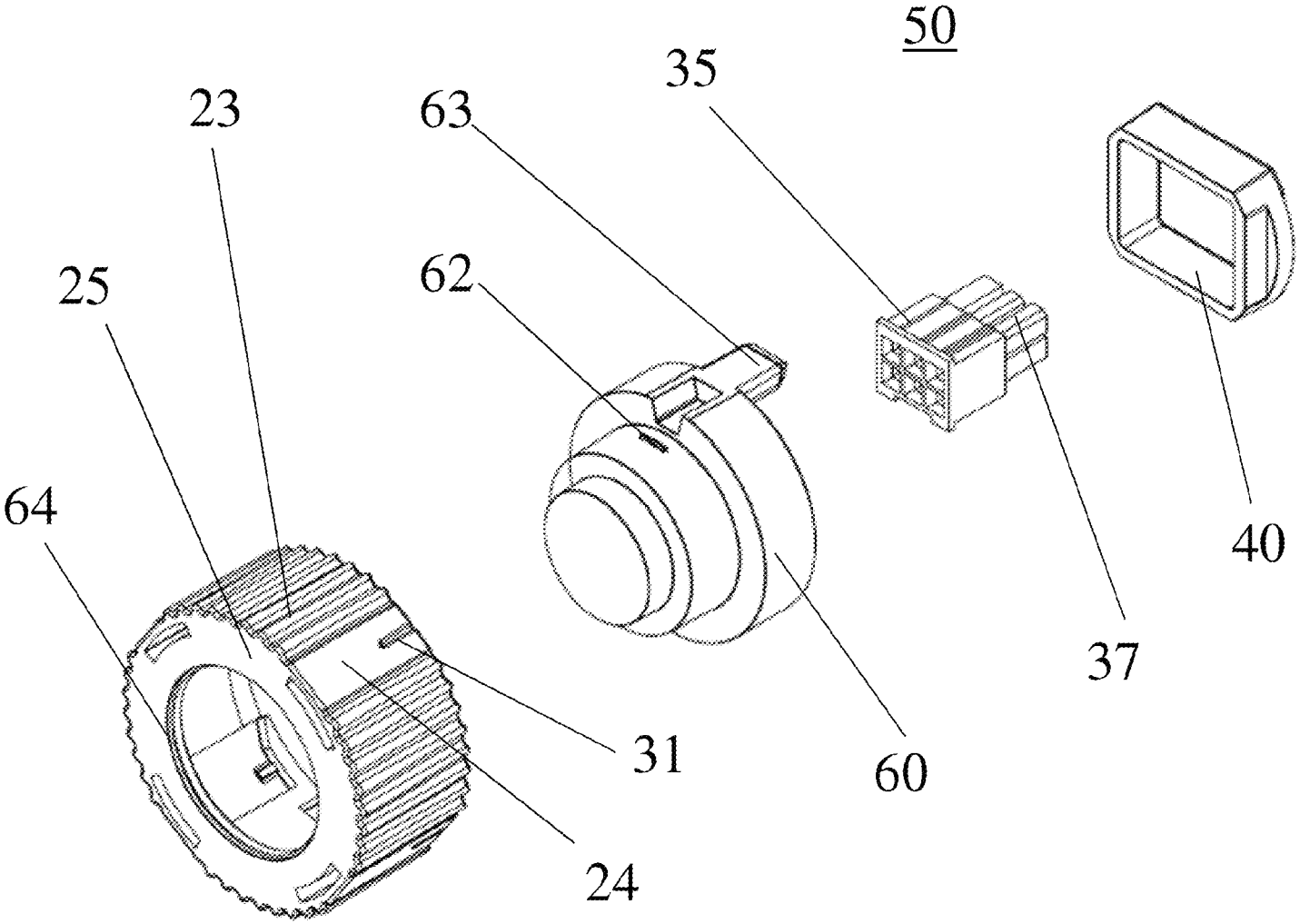
FIG. 3 is an exploded view of a male shorting cap.

With reference to FIG. 3, an exploded view of the male shorting cap 50 is shown. The male shorting cap 50 is separated into its main components: the twist-lock ring 25, a fitting 60 for shorting the electrical connection, the wire housing 35 and an optional male gasket 40. The fitting 60 has a plug lip 62 which, when the fitting 60 is inserted within the twist-lock ring 25, slips past the inner diameter 64 of the twist-lock ring 25 and expands again, rotatably mounting the twist-lock ring 25 on the fitting 60 so that the twist-lock ring 25 rotates freely while still being held onto the fitting 60. The fitting 60 is hollow and shaped in such a way so as to securely fasten into it the wire housing 35, the gasket 40 and the wiring used to bridge the electrical connections within the wire housing 35. The fitting 60 also comprises an upper fin 63 and a lower fin 67 (not shown), which must be aligned with the upper and lower grooves 93, 95 (not shown, See FIG. 4) of the female receptacle 75 in order to be fastened to it. Meanwhile, the wire housing 35 further comprises fingers 37, which are inserted into the female wire receptacle 85 (See FIG. 4) and can terminate the wiring within said female wire receptacle 85. In one embodiment, as is the case with the male plug 10, the optional gasket 40 makes contact with the optional female gasket 80 in order to seal the shorting cap 50 with the female receptacle 75 for wet applications.

Figure 4:
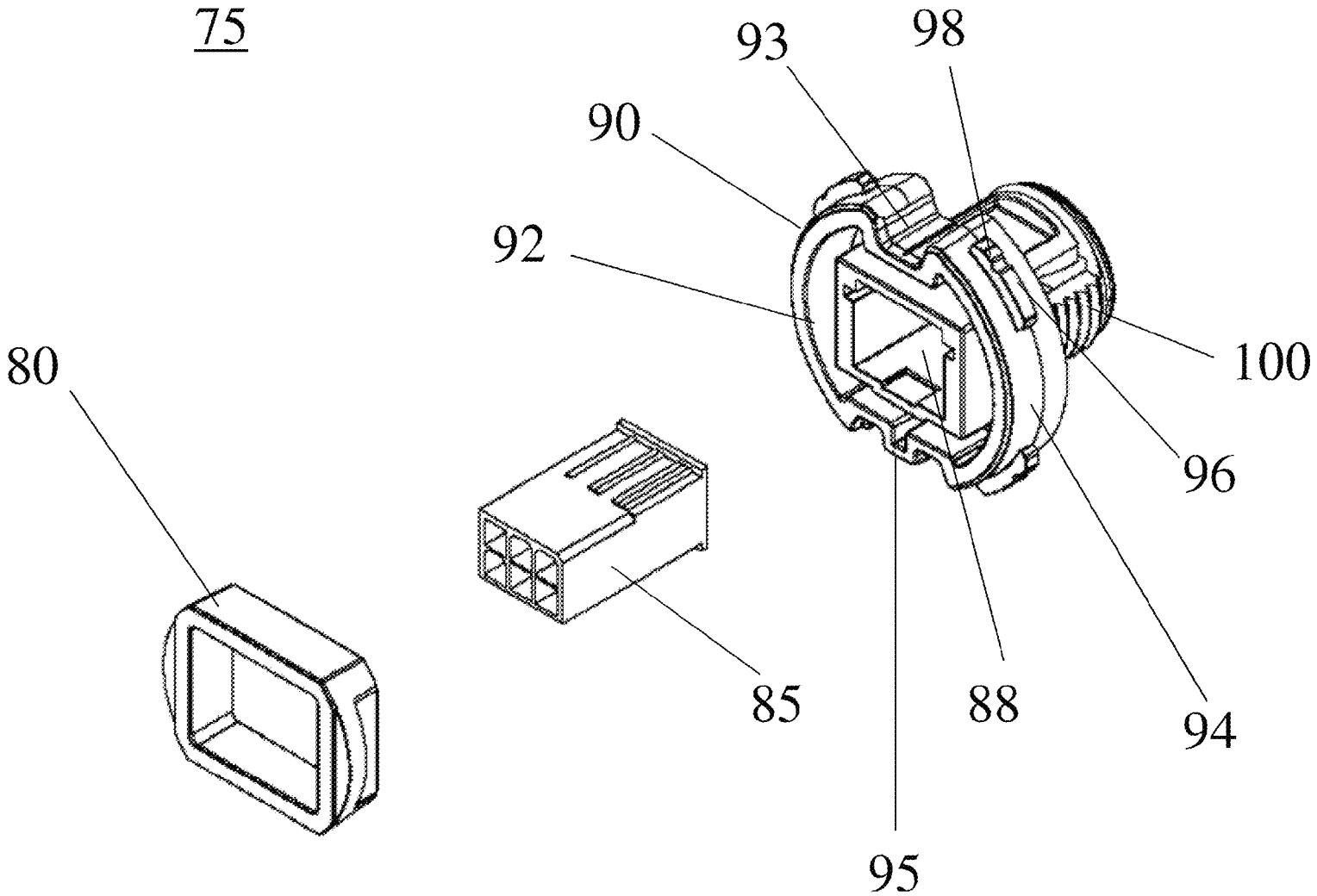
FIG. 4 is an exploded view of a female receptacle.

With reference to FIG. 4, an exploded view of the female receptacle 75 is shown. The purpose of the female receptacle 75 is to attach to the light fixture 2 so as to provide a quick connection with its male plug 10 or shorting cap 50 counterpart. The female receptacle 75 is mounted through the knockout 4 of the light fixture 2 and is held in place by a nut (not shown) that fits over a threaded back end 100 and removably affixes the female receptacle 75 within the knockout 4. The female receptacle 75 comprises: an optional female gasket 80, a female wire receptacle 85 and a female receptacle 90. The female receptacle 90 comprises of an inner aperture 88, which serves to securely contain the female wire receptacle 85, and an outer aperture 92, which serves to fasten the female gasket 80. The female receptacle 90 also comprises a cylindrically shaped outer frame 94 further comprising four protrusions 96 (three shown), each having a small notch 98. The female receptacle 90 is slim, preferably less than ½" in depth, such that if preinstalled within the light fixture 2 it does not protrude excessively and no change in packaging (not shown) for the light fixture 2 is required. The notch 98 is utilized to lock into place, engaging with nubs 110 (not shown, See FIG. 6*a*) of the twist-lock ring 25. The female receptacle 90 further comprises a groove 93, which serves to align the fins 27, 63 (not shown, See FIGS. 2 and 3) of either the male plug 10 or the male shorting cap 50, respectively.

Figure 5:
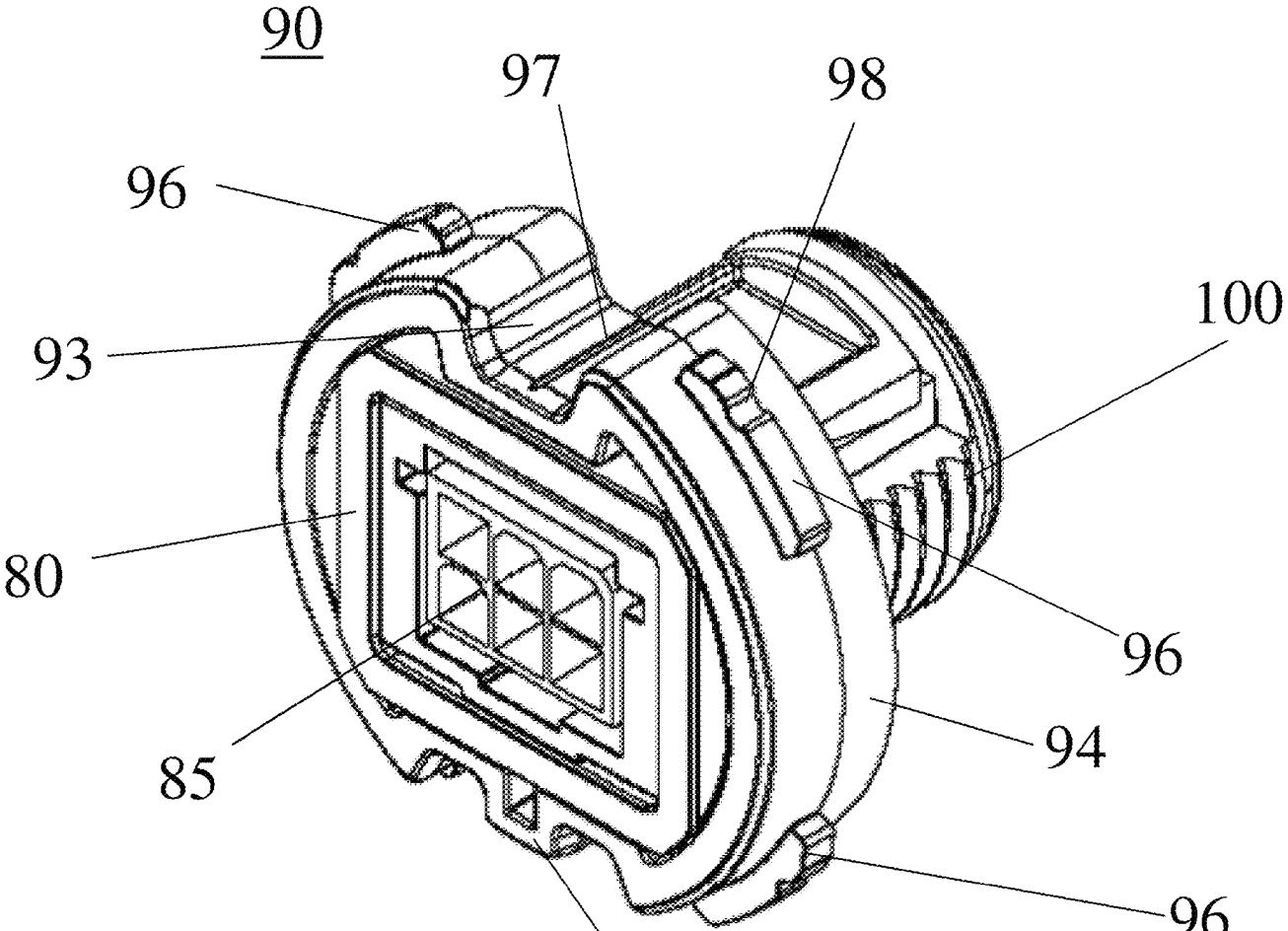
FIG. 5 is a perspective view of a female receptacle.

With reference to FIGS. 4 and 5, the female receptacle 75 is shown in greater detail. The optional female gasket 80 and the female wire receptacle 85 are shown within their respective places in the inner and outer apertures 88, 92. Three of the four protrusions 96 are shown and the notches 98 can be seen in greater detail. The threaded back end 100 of the female receptacle 90 serves to be fastened into the light fixture 2 by means of a nut (not shown). The upper and lower grooves 93, 95 are for aligning the male plug with the female receptacle 90. Within said grooves 93, 95 are two female alignment markers 97, (only one shown), utilized to align with the male alignment markers 31 (See FIG. 3) to facilitate twist-lock ring 25 connection.

Figure 6A:
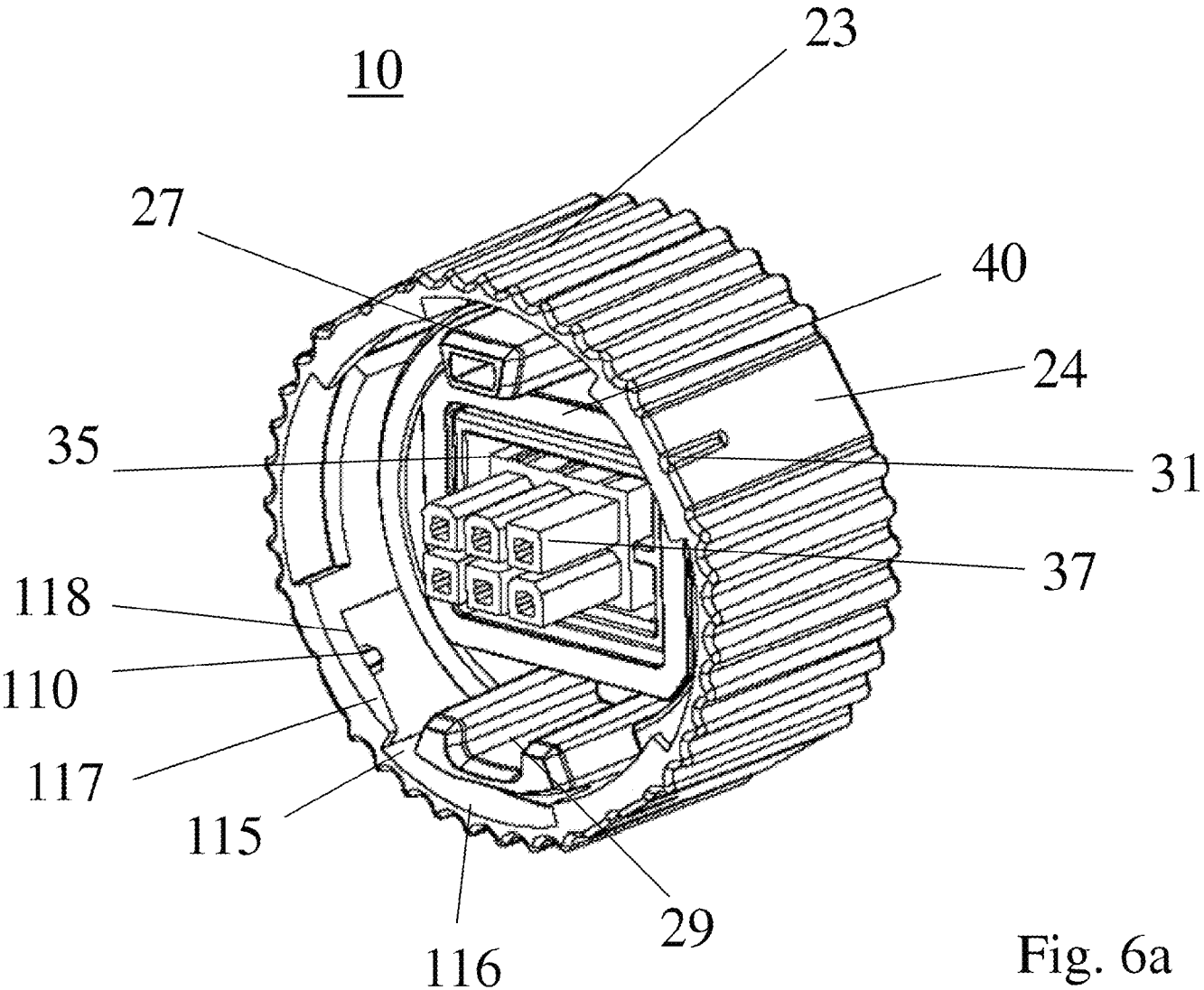
Figure 6B:
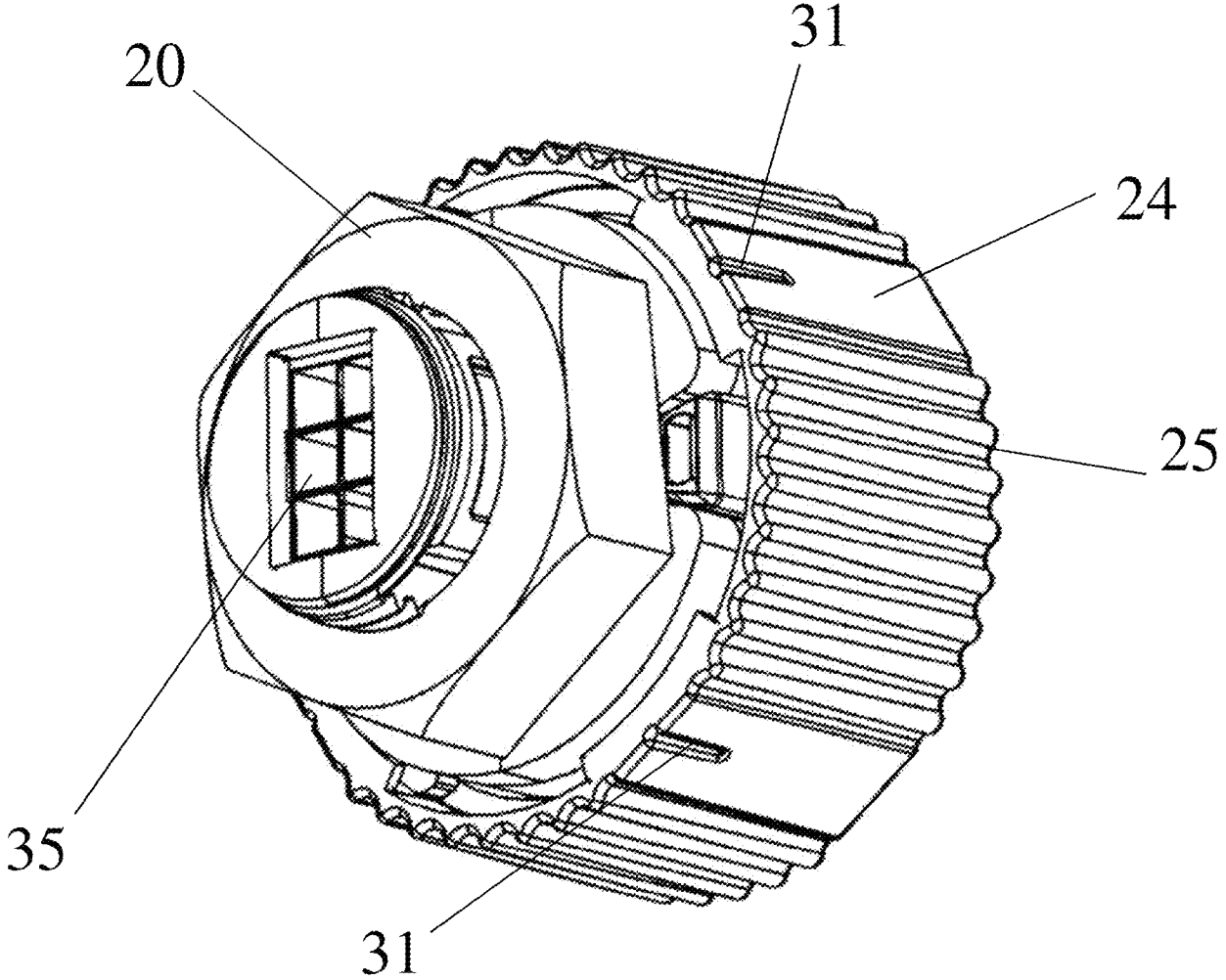

With reference to FIGS. 5, 6*a*, 6*b* and 7, the male plug 10 is now shown in larger scale, in particular FIG. 6*a* showing the front of the male plug 10 and FIG. 6*b* showing the rear of the male plug 10. The optional male gasket 40 and the wire housing 35 are also shown secured within the male plug 10, and the fingers 37 are seen protruding from the optional male gasket 40. The male plug 10 is cylindrically shaped, having a knurled outer edge 23 in order to provide grip for the installer. The male plug 10 is able to engage the protrusions 96 of the outer frame 94 of the female receptacle 75 by means of indentations 115 and nubs 110, located on the inner circumference of the twist-lock ring 25, that serve to latch onto the female receptacle 75. The indentations 115 have gaps 116 that provide an opening of wider diameter along the inner circumference of twist-lock ring 25, into which the protrusions 96 may pass. Then, as the twist-lock ring 25 is turned, the protrusions 96, already within indentations 115, are engaged and guided by ramps 117 onto lands 118, where the protrusions 96 rest and the nubs 110 engage notches 98 to lock the twist-lock ring 25 into position over the outer frame 94 of the female receptacle 75. The process of guiding the protrusions 96 by ramps 117 pulls the female receptacle tight within the male plug 10, and once the protrusions 96 come to a rest on the lands 118, as both protrusion 96 and land 118 are perpendicular to any axial forces separating the male plug 10 and female receptacle 75, they do not separate unless the twist-lock ring 25 is turned.

With reference to FIGS. 5, 6*a* and 8, wherein FIG. 8 shows the mated male plug and female receptacle viewed with the twist-lock ring 25 hidden, the male plug 10 and female receptacle 75 are aligned as they fit together, so that the correct electrical connections are made as the fingers 37 engage with the female wire receptacle 85. The upper and lower grooves 93, 95 of the female receptacle respectively engage the upper fin 27 and a lower fin 29 of the splice receptacle 30 of the male plug 10. The lower groove 95 has a different fitting from the upper groove 93, so that they are not interchangeable; in this case, the lower groove has a "W" cross-sectional shape while the upper groove 93 has a "V" cross-sectional shape, ensuring that the male plug 10 and female receptacle 75 can only be mated to each other in one orientation. The upper fin 27 therefore corresponds to the "V" shaped groove with a "V" shaped cross-section, and the lower fin 29 corresponds with the "W" shaped groove with a "W" shaped cross-section. The mating is shown in detail in FIG. 8, wherein the ring 25 is removed for viewing purpose only.

In order to connect the male plug 10 to the female receptacle 75, the alignment surface 24, along with the male alignment markers 31, are aligned with the female alignment markers 97 of the female receptacle 75, so that the protrusions 96 pass through corresponding gaps 116. Further, the upper and lower fins 63, 67 are aligned with the upper and lower grooves 93, 95 respectively. When the male plug 10 and female receptacle 75 are pushed together, the upper and lower fins 63, 67 engage with the upper and lower grooves 93, 95, and the protrusions 96 pass through the gaps 116. By virtue of its shape, the fingers 37 of the male plug 10 will be aligned with the female wire housing 85, and the user pushes one device into the other which creates an electrical connection. Once this connection has been secured, the installer twists the twist-lock ring 25, which will turn independently of the male plug 10, such that the protrusions 96 engage with the ramps 117 to rest on the lands 118, the action pulling the female receptacle 75 towards and within the male plug 10, and finally with the turning of the twist-lock ring 25 the nubs 110 connect and engage the notches 98. The twist-lock ring 25 can only be rotated in one direction such that when the male plug 10 and female receptacle 75 mate, the twist-lock ring 25 can only turn in the locking direction and once locked, the twist-lock ring 25 does not rotate freely. This provides both a tactile and audible signal of positive engagement and electrical connection for the installer, and provides an easy and secure connection without the use of tools. The exact same operation will occur should one wish to connect the male shorting cap 50 with the female receptacle 75 instead. Additionally, the alignment markers 97 on the female receptacle 75 may be lined up with a mark or etching (not shown) on the light fixture 2 so as to keep the upper and lower grooves 93, 95 in a 0 and 180 degree position relative to the mark or etching (not shown). Thus, the male and female alignment markers 31, 97 and a mark on the fixture (not shown) would serve as visual aids to further simplify the connection. Once connected, the connection is not only electrical but is also mechanically weight-bearing. For instance, the connection can hold up peripherals 6 without requiring that the peripherals 6 be independently supported.

With reference to FIG. 9, the inside of splice box 8 is shown in greater detail. The male plug 10 can be seen connected to both the female receptacle 75 (not shown) on light fixture 2 and the splice box 8, and is fastened to said splice box 8 by means of the male plug nut 20. The wiring 124 can be seen protruding from the wire housing 35 (not shown, See FIG. 2), and this wiring 124 ultimately connects to the wiring of the peripheral 6. The lid (not shown) of the splice box 8 would be connected by means of screws 126 and by catches 128 that would grip onto cavities (not shown) in the lid. One skilled in the art would appreciate that any number of peripherals requiring an electrical connection may be secured to the light fixture 2 by means of the electrical twist-lock connector.

One skilled in the art would appreciate that the twist-lock mechanism described above is merely one way for the wire housings to be secured together so as to produce a secure and durable connection. Other fastening means may be used to secure the male plug and female receptacle together without deviating from the scope of the invention.

The copper wire within each of the fingers 37 of the wire housing 35 (Molex™ for example) is not exposed, so the system may remain live while being connected, without risk of electrical shock to the installer, which facilitates the installation. This feature also extends to the peripherals 6 such as motion sensors, which may be installed while the system is live so as to test the peripheral 6 right away and without needing to power down and darken the work area. When a peripheral 6 is defective, it may be removed again without the inconvenience of powering down the system. One would simply replace the peripheral 6 with the shorting cap 50 to return to normal operation without the peripheral 6. One skilled in the art would appreciate that the plurality of knockouts located throughout the splice box 8 and lid 9 would serve to allow different positions for connection and power entry as is desirable for each application. The knockouts 4 are made solid and the lid contains an aperture for ring gasketing such that the splice box may be made water proof if desired.

With reference to FIG. 10, a second embodiment of the female receptacle 275 is shown. A threaded back end 200 of the female receptacle 275 is also shown in greater detail, normally thread around a nut (not shown). In this figure, the female receptacle 275 is shown connected to the male plug 10. In this second embodiment, the female receptacle 275 is also comprised of a filler 202. The filler 202 allows the nut (not shown) to be tightened more securely around the female receptacle 275 and to thereby prevent the female receptacle from spinning within a knockout.

The use of the electrical connector according to the present invention allows for numerous specific pre-wirings of light fixtures resulting in less ballasts being required to provide a source of power to a number of light fixtures wired in tandem. The current practice used by electricians is to purchase light fixtures with one ballast per fixture thus requiring the electrician to make modifications to each light fixture to allow for each light fixture to be wired to one another.

With reference to FIGS. 11-18, a number of fixtures are shown with specific wiring arrangements wherein the use of these fixtures in tandem minimizes the use of ballasts. As well as quick interconnections can be made through the use of the electrical connector of the present invention. FIGS. 11-18 each have an assigned wiring arrangement such that FIG. 11 displays wiring arrangement A, FIG. 12 displays wiring arrangement B, FIG. 13 displays wiring arrangement C, FIG. 14 displays wiring arrangement D, FIG. 15 displays wiring arrangement E, FIG. 16 displays wiring arrangement BB, FIG. 17 displays wiring arrangement CC and FIG. 18 displays wiring arrangement EE.

With further reference to FIGS. 11-18, each light fixture has a male plug 10 and a female connector 75 as shown. With specific reference to FIGS. 11, 13, 14 and 17, these fixtures each have a socket 305, a ground 310 and a disconnect 300, and while each fixture has the same components, the wiring arrangements are different for the respective FIGS. A worker skilled in the relevant art would be familiar with a disconnect as shown in the wiring arrangement as such a disconnect is required under various codes and is used to disconnect all power to a light fixture during manipulation or service by an electrician. With specific reference to FIGS. 12 and 16, the light fixtures have a single ballast 315 as shown and the respective wiring arrangement as shown in these Figures. With specific reference to FIGS. 15 and 18, the light fixtures have multi-ballasts 320 present in the light fixture as well as four sockets 305. The light fixture in FIG. 17 also has four sockets 305 without a ballast.

Based on the various wiring diagrams as shown under FIGS. 11-15, the following table shows the various combinations possible allowing for the light fixtures to be wired in tandem.

SINGLE LAMP PROFILE STRIPS

| # FIXTURES IN TANDEM | | APPROVED SEQUENCES | | | |
|---|---|---|---|---|---|
| 4 | * | A | B | C | D |
| 4 | | A | B | C | E |
| 4 | | B | C | D | E |
| 4 | | E | D | E | D |
| 4 | | E | E | E | D |
| 4 | | E | E | D | E |
| 4 | | E | D | E | E |
| 4 | | E | E | E | E |
| 3 | * | A | B | C | |
| 3 | * | B | C | D | |
| 3 | | E | E | D | |
| 3 | | E | D | E | |
| 3 | | E | E | E | |
| 2 | * | E | D | | |
| 2 | | E | E | | |
| 1 | * | E | | | |

* MOST COST EFFECTIVE & RECOMMENDED

NOTE:

B & E ARE MASTER STRIPS WITH MULTI-LAMP BALLASTS AND A, C, & D, ARE SLAVE STRIPS WITHOUT BALLASTS.

As can be seen, up to four fixtures may be used with a single ballast, and the approved sequences of fixtures in tandem and the position of the ballast in each sequence is shown. In this discussion, as noted above, B and E are master strips containing multi-lamp ballasts, and A, C and D are receiver strips without ballasts. Male plug 10 and female receptacle 75 are prewired and mechanically mounted to the ends of each fluorescent strip configuration (A, B, C, D, & E) and are connected by using the twist-lock system described above at the point of installation to provide both electrical and mechanical connections. Both primary power and secondary ballast circuiting is prewired such that power may be introduced to any fixture in the row mounted series. For individually mounted fixtures, a prewired cable may be offered to allow for simple electrical connections between fixtures through the use of the electrical connector of the present invention.

Based on the various wiring diagrams as shown in FIGS. 16-18, the following table shows the various combinations possible allowing for the light fixtures to be wired in tandem.

| Two lamp Profile Strips | |
|---|---|
| # of Fixtures in Tandem | Approved Sequence based on Wiring arrangement |
| 2 | BB CC |
| 1 | EE |

As can be seen from the above tables, a system of fixtures can be created with at least one or more light fixture in tandem with the use of the electrical connector of the present invention and the required wiring arrangement.

In another embodiment of the present invention, a weight-bearing electrical connector system for placement within a standard knockout of a light fixture is provided. The system comprises a male plug having a male wire housing having one or more electrical wires and a female receptacle having a wire receptacle having one or more electrical wires wherein the male and female receptacles are mechanically fastened to one another and as they are fastened, the male wire housing is pushed into the wire receptacle, thereby creating one or more electrical connections. The electrical connector system as described under this embodiment has both of the connectors fastened within knockouts by a nut. The electrical connector system as further described under this embodiment may have a preinstalled connector fastened within the knockout. The electrical connector system further described under this embodiment may have the connector protruding less than ½" from the light fixture. The electrical connector system as described above may have a standard knockout measuring ⅞" with the male wire housing and the wire receptacle each having six electrical wires therein. The electrical connector system as described under this embodiment may further comprise a splice box connecting a power supply and the male plug, or the splice box may connect a peripheral and the male plug. The electrical connector system as described under this embodiment may be adapted to carry communication signals.

A worker skilled in the relevant art would also be familiar with the connectors being interchangeable whereas rather than having a male plug secured to the electrical box, a female receptacle could be utilized with a male plug then secured to the female receptacle as defined above. A worker skilled in the relevant art would be familiar with the interchangeability of the connectors without modifying the scope of the present invention.

A worker skilled in the relevant art would also be familiar with various locking mechanisms which could be utilized in order to secure the male plug to the female receptacle such as a clip, snap or pressure fitting other than the described twist-lock ring as described in the drawings which is part of the locking mechanisms used in one embodiment of the present invention.

Although the invention has been described above by reference to certain embodiments of the invention, the invention is not limited to the embodiments described above. Modifications and variations of the embodiments described above will occur to those skilled in the art in light of the above teachings. Moreover, with respect to the above description, it is to be understood that the optimum dimensional relationships for the component members of the present invention may include variations in size, material, shape, form, and manner of operation.

What is claimed is:

1. An electrical connector for forming an electrical connection on a light fixture having a number of knockouts, comprising:

a female receptacle adaptable to be connected to one or more knockouts in the light fixture, said female receptacle further comprising an upper and lower groove;

a male plug adaptable to be connected to the female receptacle, said male plug further comprising an upper and lower fin for engagement with the upper and lower groove of the female receptacle; and a twist-lock ring connected to the male plug, and wherein the male plug and female receptacle are aligned and oriented through the upper and lower fins and upper and lower grooves and further connected through the twist-lock ring.

2. The electrical connector of claim 1, wherein the male plug has an opening having a wire housing.

3. The electrical connector of claim 2, wherein the wire housing has fingers to connect the female receptacle to the male plug.

4. The electrical connector of claim 3, further comprising a male gasket secured within the male plug.

5. The electrical connector of claim 1, further comprising a shorting cap connected to the male plug.

6. The electrical connector of claim 1, wherein the female receptacle has a wire receptacle.

7. The electrical connector of claim 6, wherein the female receptacle has an outer frame.

8. The electrical connector of claim 7, wherein the outer frame has one or more protrusions.

9. The electrical connector of claim 8, wherein the one or more protrusions have one or more notches.

10. The electrical connector of claim 1, further comprising a splice box connected to the male plug.

11. The electrical connector of claim 10, further comprising a motion detector connected to the splice box.

12. The electrical connector of claim 10, further comprising a power source connected to the splice box.

13. A system of light fixtures comprising:

at least two or more light fixtures connected in tandem wherein each light fixture has a female receptacle adaptable to be connected to one or more knockouts in the light fixtures, and said female receptacle further comprising an upper and lower groove, a male plug adaptable to be connected to the female receptacle, said male plug further comprising an upper and lower fin for engagement with the upper and lower groove of the female receptacle.

* * * * *